United States Patent [19]

Herold et al.

[11] 3,964,396

[45] June 22, 1976

[54] SPIN ACTUATED RELEASE MECHANISM

[75] Inventors: Stanley J. Herold, Switz City; Donald E. Lagrange, Washington; John E. Laswell, Bloomfield, all of Ind.

[73] Assignee: The United States of America as represented by the Secretary of the Navy, Washington, D.C.

[22] Filed: Mar. 19, 1975

[21] Appl. No.: 559,959

[52] U.S. Cl. ..... 102/79; 102/35.6; 102/83; 244/150

[51] Int. Cl.[2] ..... F42B 4/12; F42C 15/22

[58] Field of Search ..... 102/79, 83, 84, 4, 35, 102/35.6, 37.1, 37.6, 70 R; 244/150, 3.27, 3.28; 89/1.5 D

[56] References Cited

UNITED STATES PATENTS

| | | | |
|---|---|---|---|
| 2,144,056 | 1/1939 | Halbach | 102/35 |
| 2,449,170 | 9/1948 | MacLean et al. | 102/84 |
| 3,421,442 | 1/1969 | St. Clair | 102/83 |
| 3,780,659 | 12/1973 | Kulesza et al. | 102/81 X |

*Primary Examiner*—David H. Brown
*Attorney, Agent, or Firm*—R. S. Sciascia; Paul S. Collignon

[57] ABSTRACT

A release mechanism for use with an air-dropped store having a timed firing mechanism which can be set for different time intervals. Action is initiated by a plurality of dynamic pressure sensing fins which, upon actuation, first unlock an inertia locking arm and then the fins impart a rotation to the store which rotation, in turn, causes the locking arm to pivot and initiate a timer. The timer, in turn, initiates separation of the release mechanism from the store.

4 Claims, 8 Drawing Figures

SPIN ACTUATED RELEASE MECHANISM

BACKGROUND OF THE INVENTION

The present invention relates to a release mechanism for a pyrotechnic item, such as an aircraft parachute flare, and more particularly to a release mechanism which is actuated by fins which first open and then impart a spin to the release mechanism to unlock an inertia arm preventing operation of a timer.

An aircraft parachute flare is normally provided with three sections or components, namely a parachute, a section containing a pyrotechnic composition and a triggering mechanism. The triggering mechanism, in addition to igniting the pyrotechnic composition, frequently provides for a delay period so that the aircraft parachute flare can free fall a predetermined distance prior to parachute opening. This free fall feature permits the aircraft parachute flare to be launched or dropped from relatively high altitudes, but prevents ignition of the pyrotechnic composition until the parachute flare is at an altitude such that light from the flare will illuminate the ground below.

As an aircraft parachute flare is an expendable item, possibly the most important features on these flares are the safety features which attempt to prevent accidental or premature ignition of the pyrotechnic composition. As the illuminating materials which are used in present day flares provide extreme heat upon burning, any accidental ignition of these flares could result in a catastrophic disaster, particularly if the flares are in storage aboard a ship. In order to provide some measure of safety, most present day flares are provided with a safety pin which is kept in position until the flare is mounted in a launching rack on an aircraft. In the event the aircraft returns with flares, the safety pins are reinserted.

In one type of fuze widely used by the military departments, a lanyard is provided and has one end attached to the fuze and the other end attached to the aircraft. Upon dropping the store to which the fuze is attached, the lanyard actuates a triggering mechanism which fires the store. While a lanyard is normally successful in triggering a fuze, it has a disadvantage of sometimes causing an undesired triggering, such as the dropping of a store during landing or taxing of an aircraft. In a carrier landing, for example, an accidental dropping of a flare which is triggered by a lanyard, could cause a serious shipboard fire.

In order to eliminate the need for a lanyard, a fuze was developed for the Navy which is initiated by the environment. This device is shown and described in U.S. Pat. No. 3,780,659, entitled, "Environmental Fuze For Pyrotechnic Device", which issued Dec. 25, 1973, to Stanley Kulesza and Max Sapsowitz. In this device, fuze action is started by a plurality of pressure sensing fins which, upon actuation, initiates a timing mechanism and seals a bellows assembly. The bellows assembly monitors the increase of atmospheric pressure as the fuze falls and, if a predetermined pressure change occurs within a given time period, the firing pin is released to detonate a primer. In the event that the desired pressure change does not occur during a given time interval, the timing mechanism will jam and the fuze will remain in a safe condition.

SUMMARY OF THE INVENTION

The present invention relates to a spin actuated release mechanism which is adaptable to be attached to an aircraft parachute flare for deploying a parachute and igniting an illuminating composition. Action is initiated by a plurality of fins which first unlocks an inertia arm to permit rotation or pivoting of this arm, which is engaged with a timing mechanism to prevent movement. The fins are designed to impart rotation or spin to the release mechanism and, when sufficient speed is reached, the inertia arm is pivoted and is disengaged from the timing mechanism. The timing mechanism, in turn, causes the release mechanism to be separated from the store and this separation causes a parachute to deploy and the pyrotechnic composition to be ignited.

It is therefore a general object of the present invention to provide a release mechanism that will eliminate any type of accidental ignition by requiring a predetermined speed of rotation before any action can start.

Other objects, advantages and novel features of the invention will become apparent from the following detailed description when considered in conjunction with the accompanying drawings.

DESCRIPTION OF THE PREFERRED EMBODIMENT

Figure 1:
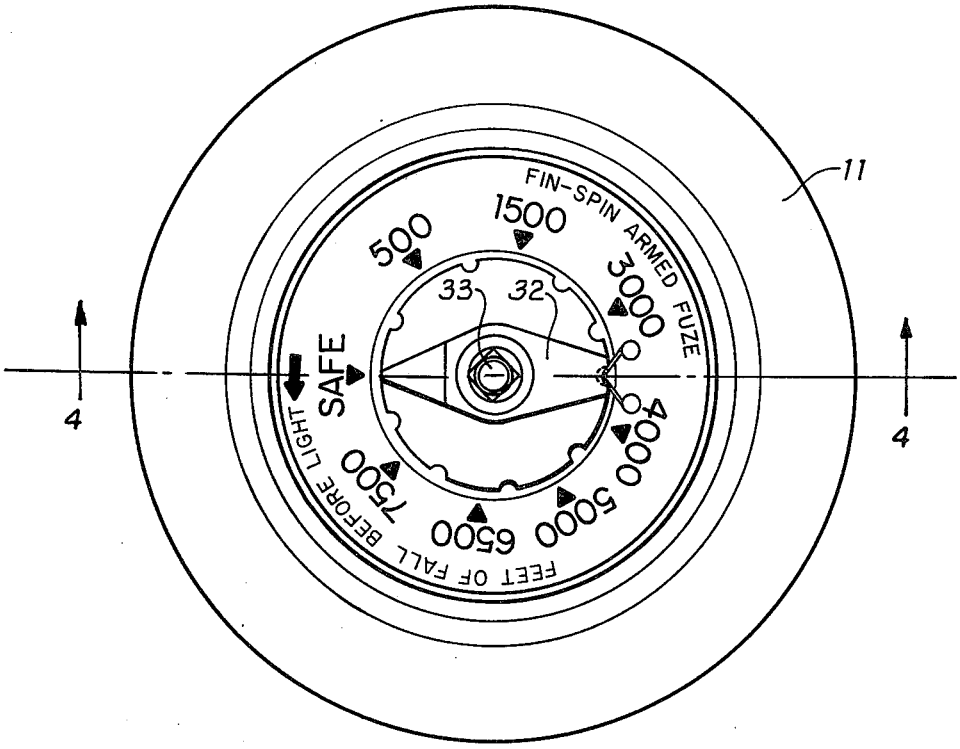
FIG. 1 is a top view of a preferred embodiment of the present invention.
Figure 2:
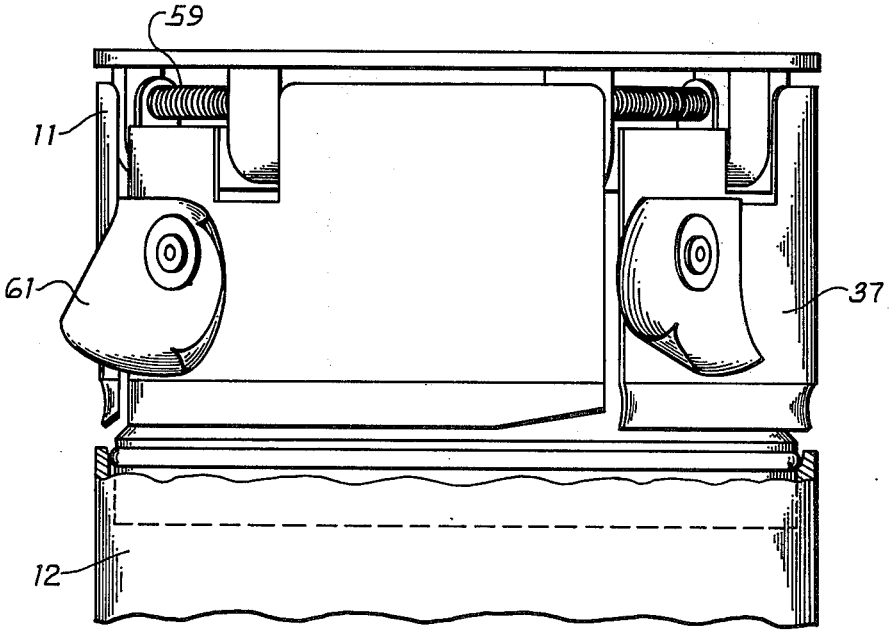
FIG. 2 is a side view of a preferred embodiment showing spin fins in a closed position.

Referring now to the drawings, there is shown a housing 11 which is releasably attached to a container 12 by means of three retractable arms 13, 14, and 15. By way of example, container 12 might contain a quantity of flare composition and a parachute and a spring (not shown) might be provided between housing 11 and container 12 for separating the housing 11 from container 12 when arms 13, 14, and 15 are retracted.

Figure 6:
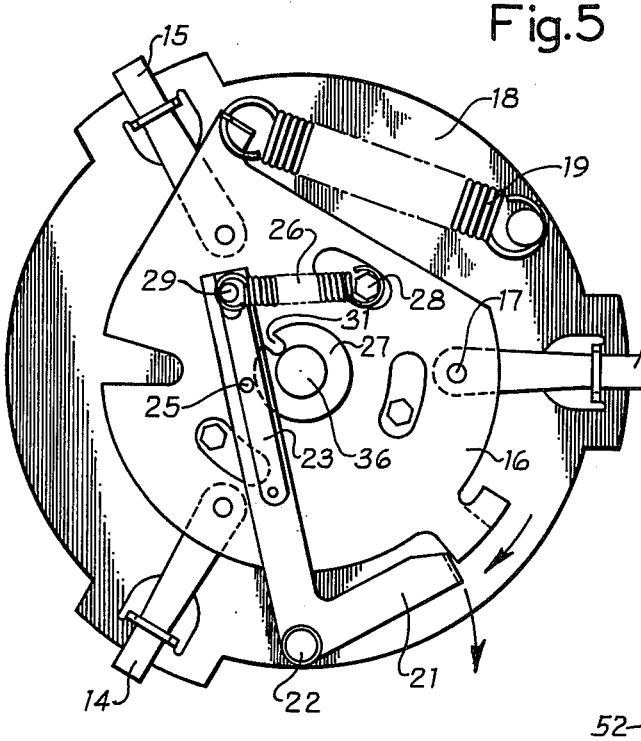
FIG. 6 is a bottom view of the release mechanism of the present invention showing a locking arrangement.

As best shown in FIG. 6 of the drawings, arms 13, 14, and 15 are pivotally attached to actuator plate 16 by means of pins 17. Plate 16, in turn, is rotatably mounted on plate 18 and spring 19 is connected to plates 16 and 18 to provide the driving force to rotate plate 16 and, in turn, actuate arms 13, 14, and 15. In FIG. 6, plate 16 is shown in a cocked position and arms 13, 14, and 15 are extended. Rotation of plate 16 is prevented by stop arm 21 which is pivotally attached to plate 18 by pin 22. A follower arm 23, which is attached to a timing mechanism 24, has a pin 25 which is biased by spring 26 against disk 27 which is rotated by timing mechanism 24. Spring 26 has one end attached to a post 28 on plate 18 and the other end of spring 26 is attached to pin 29 on the outer end of follower arm 23. Pin 29, additionally, engages with a slot in stop arm 21. Disk 27 has a notch 31 in its periphery and when pin 25 moves into notch 31, pin 29 pivots stop arm 21 about pin 22 and stop arm 21 is disengaged from actuator plate 16. Upon disengagement of stop arm 21 from plate 16, spring 19 causes plate 16 to be rotated and arms 13, 14, and 15 are retracted. By way of example, timing mechanism might be purchased as an assembled item and one source is M. H. Rhodes, Inc., Hartford, Connecticut.

Figure 4:
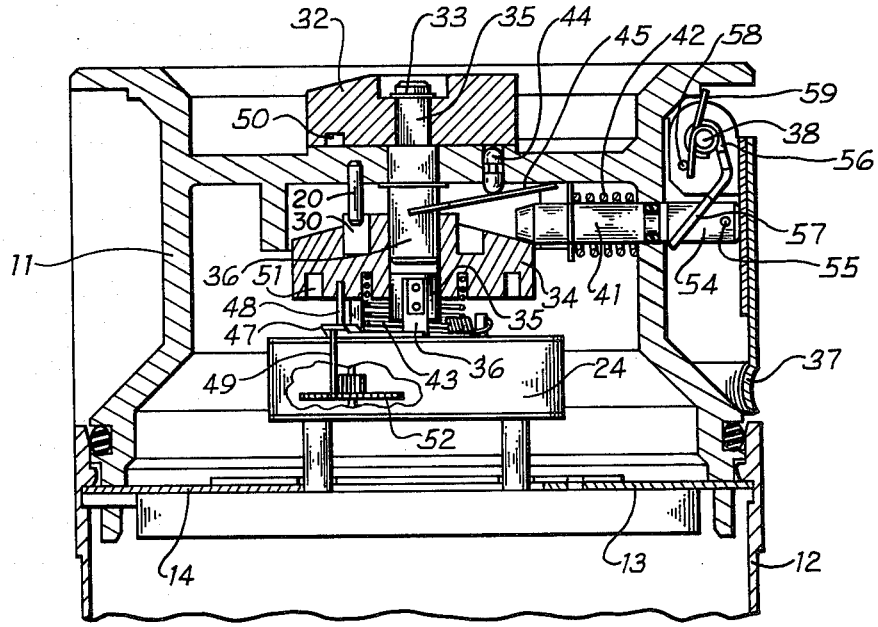
FIG. 4 is a sectional view taken on line 4—4 of FIG. 1 showing the release mechanism of the present invention in a safe condition.
Figure 5:
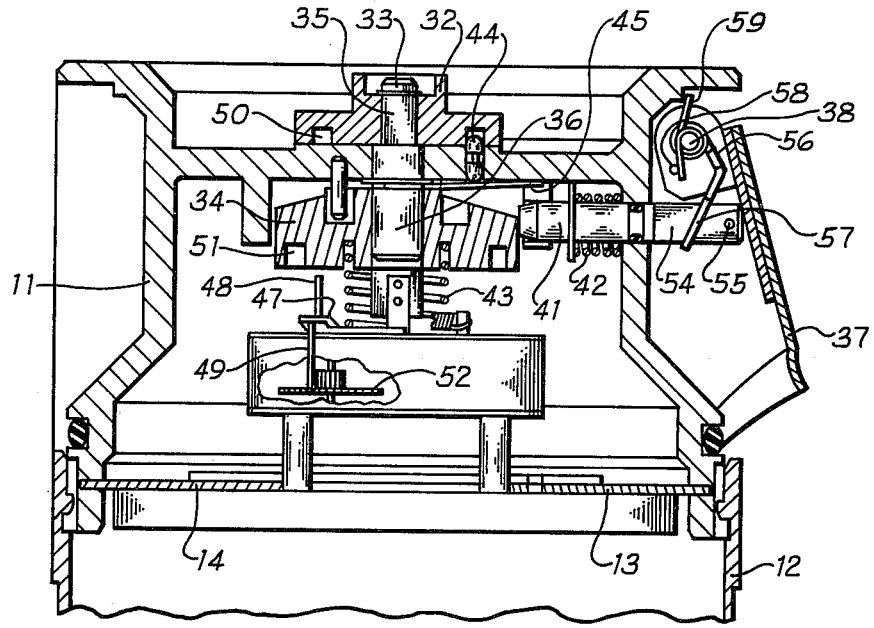
FIG. 5 is a sectional view similar to FIG. 4 of the drawings only showing the release mechanism in an unlocked condition.

Referring now to FIGS. 1 and 4 of the drawings, a knob 32 is rotatably attached to housing 11 by a shaft 33 which is connected to timing mechanism 24 through actuator 34. Shaft 33 has two square sections 35 and 36 that fit, respectively, in square holes in knob 32 and actuator 34. A square adapter 35 is pinned to shaft 36 of timing mechanism 24 and rotation of knob 32 causes rotation of actuator 34 and shaft 36 of timing mechanism 24. As disk 27 is attached to shaft 36 of timing mechanism 24, rotation of knob 32 causes rotation of disk 27. As shown in FIG. 1 of the drawings, a scale showing "Feet of Fall" is provided on the top of housing 11 so that knob 32 can be set to provide a desired delay before parachute opening is initiated.

Figure 3:
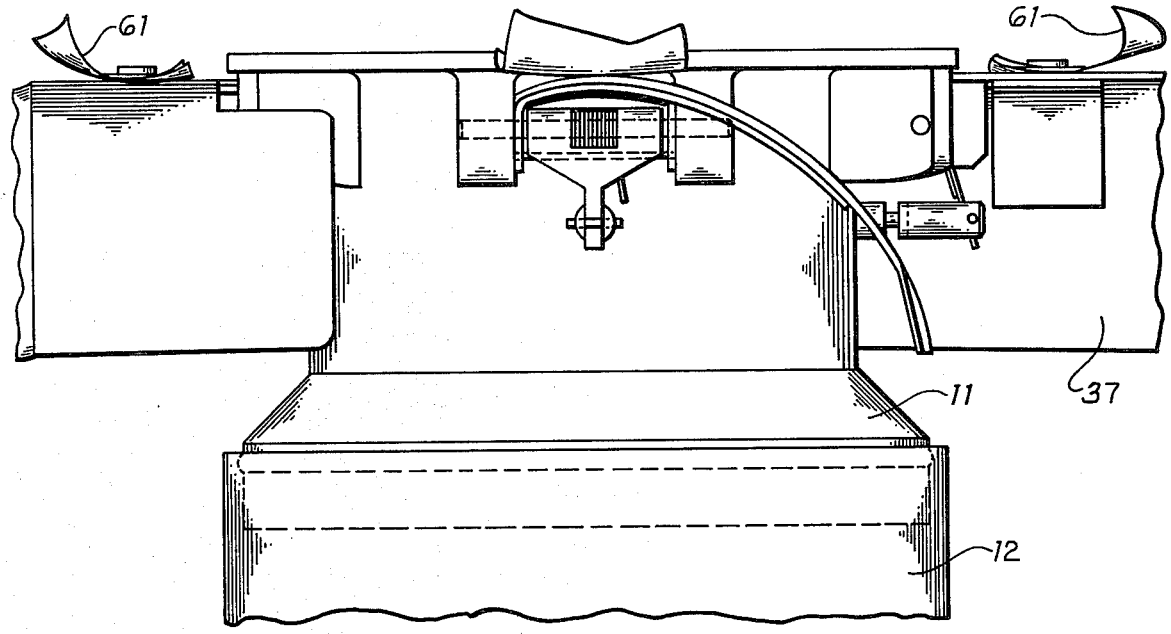
FIG. 3 is a side view similar to FIG. 2 of the drawing only showing spin fins opening.

Four arcuate fins 37 are pivotally attached to housing 11 by pins 38 and, as best shown in FIG. 3 of the drawings, each fin is pivoted at its end so that when fully opened the fins will impart a spin to housing 11 and container 12. Four fin pins 41 are slidably mounted in housing 11 and are retained in position by springs 42. As best shown in FIG. 4 of the drawings, a spring 43 is provided to bias actuator 34 upwardly, however, fin pins 41 prevent any movement until fin pins 41 are actuated by opening of fins 37. When knob 32 is set on "SAFE", as shown in FIG. 1 of the drawings, knob 32 depresses a safing pin 44, which, in turn biases a safing fork 45 against the top of actuator 34 thereby preventing upward movement of actuator 34. It can be seen then that two independent safing devices restrain actuator 34 when knob 32 is on "SAFE", that is, safing pin 44 and safing fork 45 prevent upward movement of actuator 34 and also fin pins 41 prevent upward movement of actuator 34.

Figure 7:
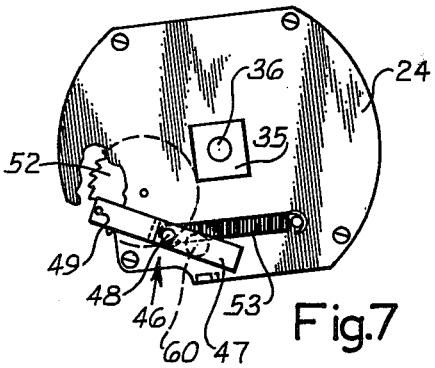
FIG. 7 is a bottom view, partly broken away, showing an inertia locking device in a locked condition.
Figure 8:
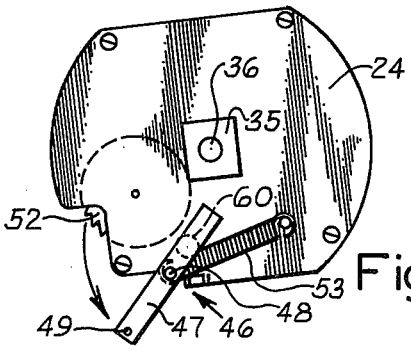
FIG. 8 is a bottom view similar to FIG. 7 only showing an inertia locking device in an unlocked condition.

An inertia locking device 46 is provided on top of timing mechanism 24 and consists of a lever 47 which is pivotally mounted on the top of timing mechanism 24. An upwardly extending pin 48 and a downwardly extending pin 49 are provided on lever 47. Pin 48 is engageable in a circular groove 51 in the bottom of actuator 34 and, when so engaged, lever 47 cannot be pivoted. Pin 49 is engageable with a toothed ratchet wheel 52 and, when so engaged, timing mechanism 24 will not operate. A spring 53 has one end attached to the top of timing mechanism 24 and the other end attached to pin 48. Referring to FIGS. 4 and 7 of the drawings, when actuator 34 is in a locked position by fin pins 41 and safing pin 44 and safing fork 45, pin 48 is in groove 51 which prevents pivoting of inertia locking device 46. Pin 49 is engaged with ratchet wheel 52 and timing mechanism 24 cannot function.

Fin pins 41 are each provided with a slot 54 in the outer end, and pins 55 are positioned transversely across each slot 54. A pin retractor 56 is rotatably positioned about each pin 38 and has an arm 57 that moves freely in slot 54 and is engageable with pin 55. A pin 58 is provided on each fin 37 and is engageable with a pin retractor 56. This arrangement permits fins 37 to partially open before there is any movement of fin pins 41, otherwise springs 42 would provide a resistive force and keep fins 37 closed. Once fins 37 are partially opened, wind will apply a greater force to them thereby opening fins 37 fully and withdrawing fin pins 41. Also this arrangement permits a coupling between fins 37 having a circular or pivotal movement and fin pins 41 having a linear movement. When a fin 37 is opened, pin 58 will move in a circular pattern and engage pin retractor 56. Pin retractor 56 will also move in a circular pattern and arm 57 will engage pin 55. Continued movement of arm 57 against pin 55 will cause fin pin 41 to retract. A spring 59 is provided for each fin 37 and provides a small force to keep a fin in a closed position until the release mechanism is launched into an airstream.

OPERATION

Assuming that the release mechanism is set on "SAFE" as shown in FIGS. 1 and 4 of the drawings, pin 49 is engaged with ratchet wheel 52 and timing mechanism 24 will not operate. Pin 48 is positioned in groove 51 of actuator 34 and prevents pivoting of inertia locking device 46 until actuator 34 is raised. Movement of actuator 34 is prevented by safing fork 45 which is biased by safing pin 44. In addition, fin pins 41 prevent movement of actuator 34.

Prior to launch from an aircraft knob 32 is set to the desired "feet of fall", as shown in FIG. 1 of the drawings. Turning of knob 32 winds-up timing mechanism 24 and also causes rotation of disk 27. Upon turning of knob 32, safing pin 44 moves upwardly into groove 50 of knob 32 and frees safing fork 45, however, actuator 34 is still restrained by fin pins 41. A stop pin 20 is provided in housing 11 and extends into a groove 30 in actuator 34. Groove 30 is not completely annular and pin 20 and groove 30 limit the travel of actuator 34 thereby preventing over-winding of timing mechanism 24.

Upon launch, wind catches and opens fins 37 and retracts fin pins 41. In order to facilitate the initial opening of fins 37, a small piece of flexible plastic material 61 is attached to the outer surface of each fin 37. Upon retraction of fin pins 41, spring 43 moves actuator 34 upwardly and pin 48 clears groove 51. Spring 53, however, maintains pin 49 in engagement with ratchet wheel 52 and timing mechanism 24 remains locked. When fins 37 are fully deployed they will impart a spin to the release mechanism and, when a sufficient rotational velocity is reached, the inertia locking device 46 will pivot about pin 60 and pin 49 will disengage from ratchet wheel 52. Timing mechanism 24 will start to run and will rotate disk 27. When pin 25 on follower arm 23 moves into notch 31 on disk 27, stop arm 21 will pivot about pin 22 and become disengaged from actuator plate 16. Spring 19 will then rotate actuator plate 16 and retract arms 13, 14, and 15, and housing 11 separates from container 12 and, upon separation, a parachute is deployed.

Obviously many modifications and variations of the present invention are possible in the light of the above teachings. It is therefore to be understood that within the scope of the appended claims the invention may be practiced otherwise than as specifically described.

We claim:

1. A release mechanism for use with an aircraft parachute flare comprising, a housing, a plurality of arms for removably attaching said housing to an aircraft parachute flare, means for actuating said arms for uncoupling said housing from said aircraft parachute flare, an ertia arm pivotally mounted in said housing for locking said means for actuating said arms, a pin attached to said inertia arm, an actuator slidably mounted to said housing and engageable with said pin attached to said inertia arm, spring means for disengaging said actuator from said pin attached to said inertia arm, a plurality of shafts slidably positioned in said housing engageable with said actuator for holding said actuator in a locking position with said pin attached to said inertia arm, and means for disengaging said plurality of shafts from said actuator and pivoting said inertia arm whereby said means for actuating said arms is unlocked.

2. A release mechanism for use with an aircraft parachute flare as set forth in claim 1 wherein said means for disengaging said plurality of shafts from said actuator and pivoting said inertia arm comprises a plurality of arcuate fins pivotally attached to said housing and connected one each with each said shaft, each said arcuate fin being movable from a retracted position with said shafts engaging said actuator to a deployed position with said shafts disengaging said actuator and whereby said arcuate fins impart rotation to said housing when deployed during a free-fall condition.

3. A release mechanism for use with an aircraft parachute flare as set forth in claim 1 wherein said means for actuating said arms includes spring means for retracting said arms, a trigger mechanism for actuating said spring means and a timer for delaying actuation of said trigger mechanism.

4. A release mechanism for use with an aircraft parachute flare as set forth in claim 3 having a shaft rotatably mounted in said housing having one end connected with said timer and having a dial on the other end thereof and stop means positioned between said dial and said actuator for preventing movement of said actuator when said dial is in one rotatable position.

* * * * *